United States Patent [19]

Schuermann et al.

[11] 4,028,958

[45] June 14, 1977

[54] SINGLE LEVER CONTROL FOR ACTUATING CONTROL VALVES AND THE LIKE

[75] Inventors: Kenneth W. Schuermann; Vernon C. Slaton, III, both of Perry, Okla.

[73] Assignee: The Charles Machine Works, Inc., Perry, Okla.

[22] Filed: Aug. 14, 1975

[21] Appl. No.: 604,657

[52] U.S. Cl. ..... 74/471 XY; 137/636.2

[51] Int. Cl.[2] ..... G05G 9/04

[58] Field of Search ..... 74/471 XY; 137/636.2

[56] References Cited

UNITED STATES PATENTS

| | | | |
|---|---|---|---|
| 2,705,971 | 4/1955 | Dorkins | 137/636.2 |
| 3,388,609 | 6/1968 | Miller | 74/471 XY |
| 3,768,328 | 10/1973 | Campbell | 74/471 XY |
| 3,811,336 | 5/1974 | Pulskamp | 74/471 XY |
| 3,831,633 | 8/1974 | Comer | 137/636.2 |
| 3,943,791 | 3/1976 | Casey | 137/636.2 X |

*Primary Examiner*—Allen D. Herrmann

[57] ABSTRACT

A single lever control adapted to actuate spaced control devices such as hydraulic valves is provided wherein a housing mountable on the body of one device and containing the actuator for that device supports both the actuating mechanism for an adjacent control device and the single control lever to actuate both devices. The mechanism has a yoke carried by a hub rotatable on the housing through which actuation of the first device is effected with the yoke pivotally supporting a single control lever which carries an extension connected through an easy assembly linkage to actuate the other control device.

11 Claims, 8 Drawing Figures

FIG. 6
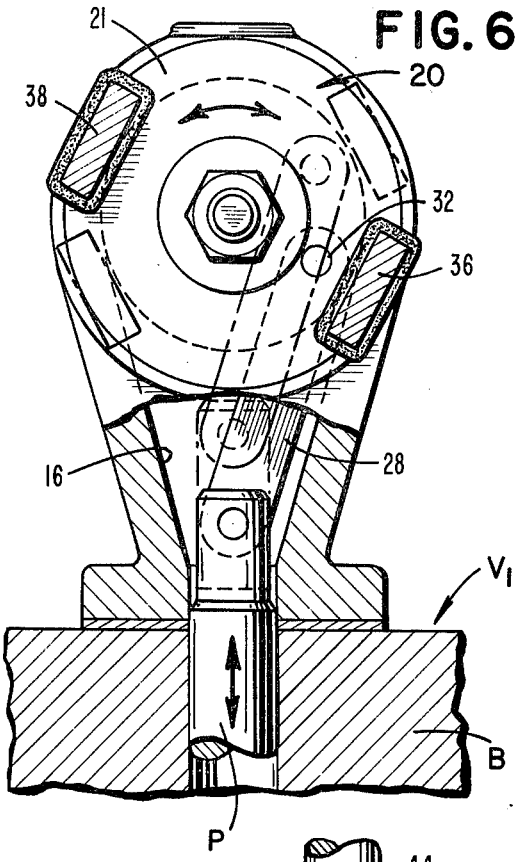
FIG. 7
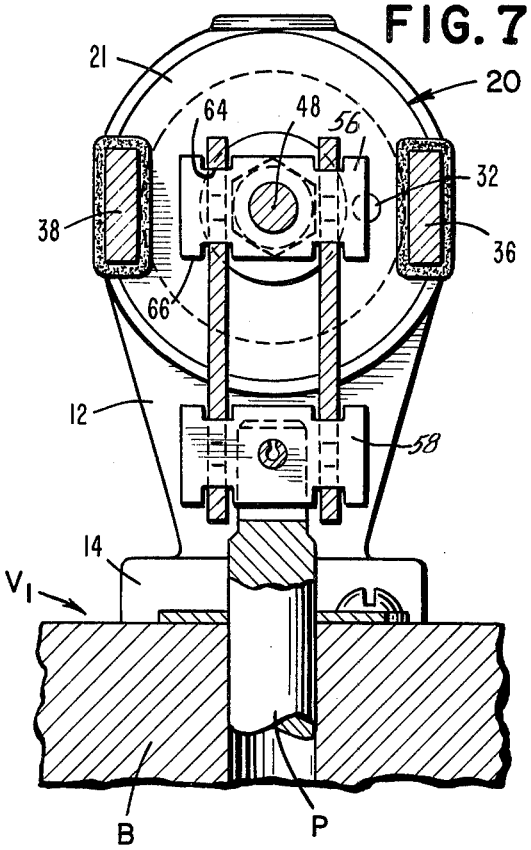
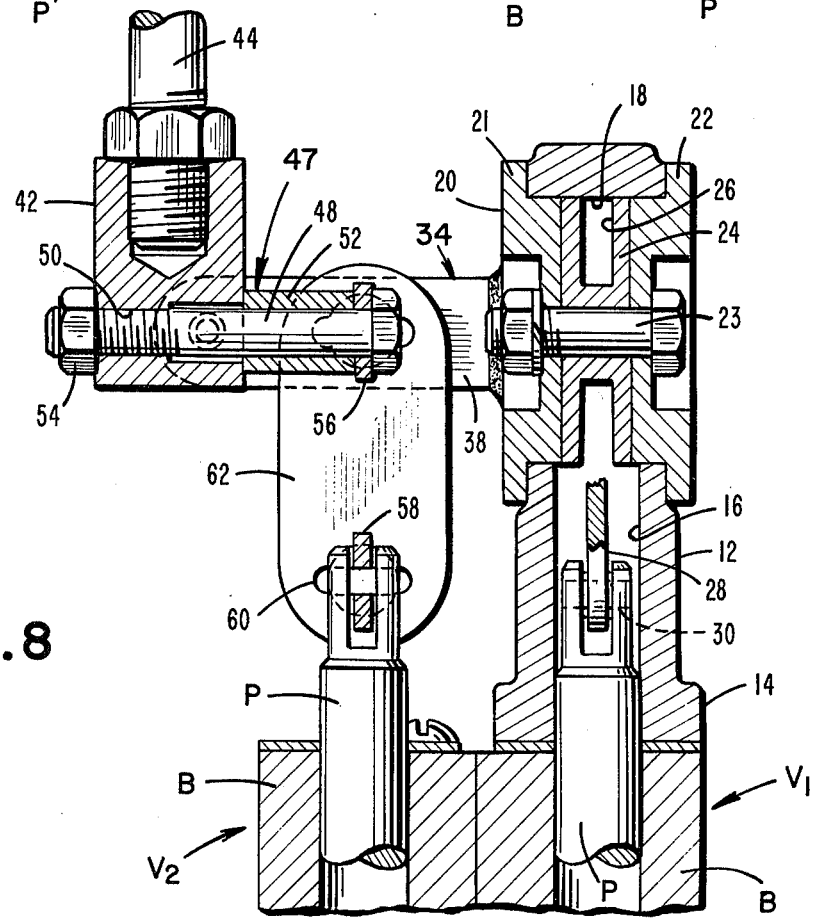
FIG. 8

SINGLE LEVER CONTROL FOR ACTUATING CONTROL VALVES AND THE LIKE

BACKGROUND OF THE INVENTION

This invention relates to a single lever control whereby multiple control devices, such as hydraulic valves employed in directing machinery functions, are actuated separately or conjointly by movements of a single control lever. More specifically the invention finds application in backhoe earth working equipment where the array of hydraulic control valves, operable to carry out the various functions of the backhoe, are utilized by actuating a multiple of the valves by means of a single control lever.

Characteristically, in providing hydraulic controls for machinery movements, such as required in carrying out the digging operations with a backhoe, a single valve having its own control lever associated therewith is employed for each backhoe component movement to be carried out. Thus a line up of the valves, each with its own control handle, requires the operator to move to and from the individual valve control levers to carry out the desired motions in the backhoe digging operation. With the complexity of the movements involved in performing the multiple earth working functions it is particularly desired by some operators to have a single lever associated with a plurality of hydraulic valves so that by movements of this single lever the plurality of hydraulic valves are actuated either separately or conjointly. By this approach, individual or compound movements of the backhoe digging bucket, dipper, boom and swing of the backhoe relative to the supporting vehicle can be most expeditiously carried out by the operator's manipulation of a single lever for multiple valves rather than having the necessity of manipulating many individual levers, each associated with a single valve.

There have been proposals in the prior art to provide mechanisms whereby a single control lever is operable through its movements to actuate a pair of hydraulic valves connected in hydraulic fluid circuits to manipulate machinery components so that multiple control functions are performed by use of the single lever. Examples of such single lever controls to manipulate a plurality of hydraulic control valves appear in the U.S. Pat. Nos. to Miller, 3,388,609; Schwerdtfeger, 3,741,031; Campbell, 3,768,328; and Comer, 3,831,633. However, these single lever control mechanisms of the prior art involve mechanisms that are not only fairly complex and cumbersome but also employ completely separate assemblies of parts in addition to and for connection with the conventional individual hydraulic valves which are to be actuated.

SUMMARY OF THE INVENTION

A principal object of the present invention is to provide a single lever control for actuating spaced control devices, such as hydraulic valves, wherein the actuator for one device has its housing employed as the support for the single control lever which is to actuate both devices and also as the support for the linkage through which another control device is actuated.

Another important object of the invention is to provide a single lever control employing the normally provided actuator and housing for one control device with the addition of a minimum of other components to achieve the single control capability for a plurality of control devices.

A further significant object of the invention is to provide a single lever control using the housing and actuator of one control device as a single control lever support and wherein linkage to actuate another control device has an assembly of pivotally interconnected parts which may quickly be assembled or disassembled to provide the single lever control for actuation of a plurality of control devices.

It is also an object in connection with the above object to provide that the pivotally interconnected parts of the linkage can be quickly assembled or disassembled by merely rotating cross bar elements relative to openings in tie links making up the assembly to engage or disengage the parts whereby parts may be easily replaced or changed.

Other objects, features, and advantages of this invention will readily become apparent from the following detailed description of an illustrative embodiment when such description is considered in connection with the appended drawings.

BRIEF DESCRIPTION OF THE DRAWINGS

FIG. 6 is a sectional view taken on line 6—6 of FIG. 2.

FIG. 7 is a sectional view taken on line 7—7 of FIG. 2, and

FIG. 8 is a sectional view taken on line 8—8 of FIG. 2.

DESCRIPTION OF AN ILLUSTRATED EMBODIMENT

Figure 1:
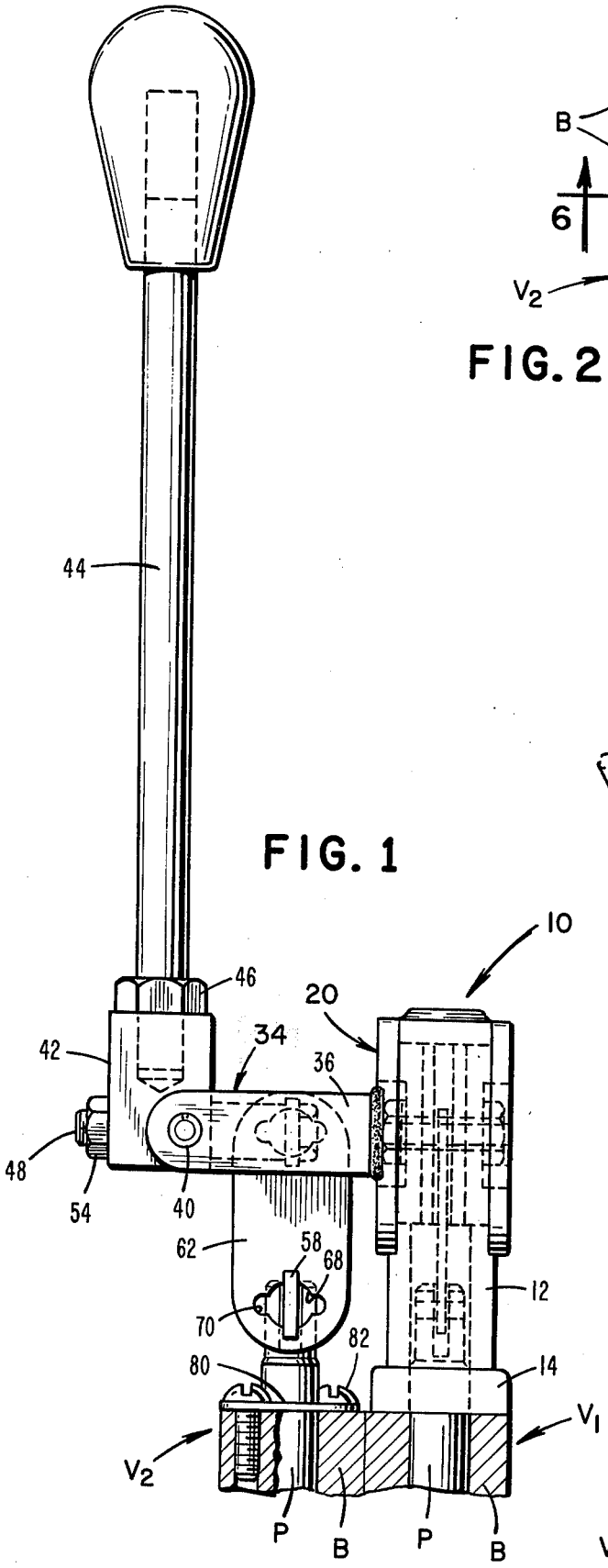
FIG. 1 is a front elevational view of the single lever control of this invention showing, in section, the bodies of two spaced hydraulic control valves which are to be actuated.
Figure 2:
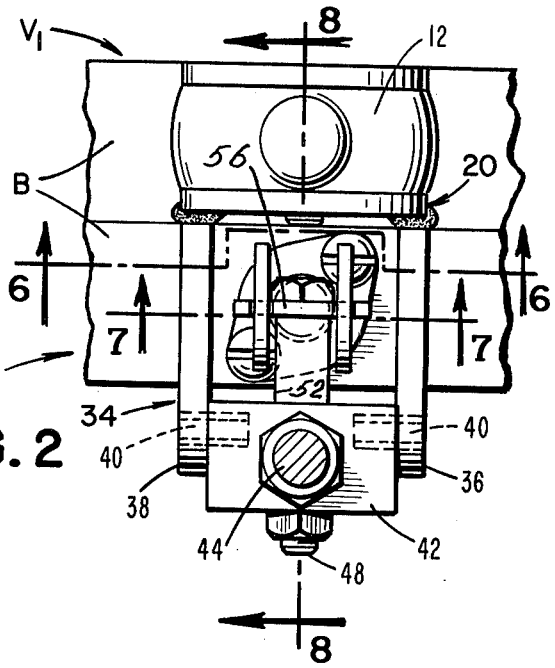
FIG. 2 is a top plan view of the single lever control shown in FIG. 1 with the control lever in section.

Referring to FIG. 1, the single lever control 10 is shown associated with a pair of control devices, illustrated as hydraulic valves V1 and V2. The valves shown may be conventional hydraulic spool valves as well known in the art and their structure is not illustrated other than a portion of the body B for each valve and a portion of the valve plunger P for each valve. As is well recognized, the valve plunger is reciprocated, i.e., raised or depressed in actuating the valve to perform its desired function in controlling flow of pressurized hydraulic fluid in the circuit to and from the component of machinery to be operated.

Figure 4:
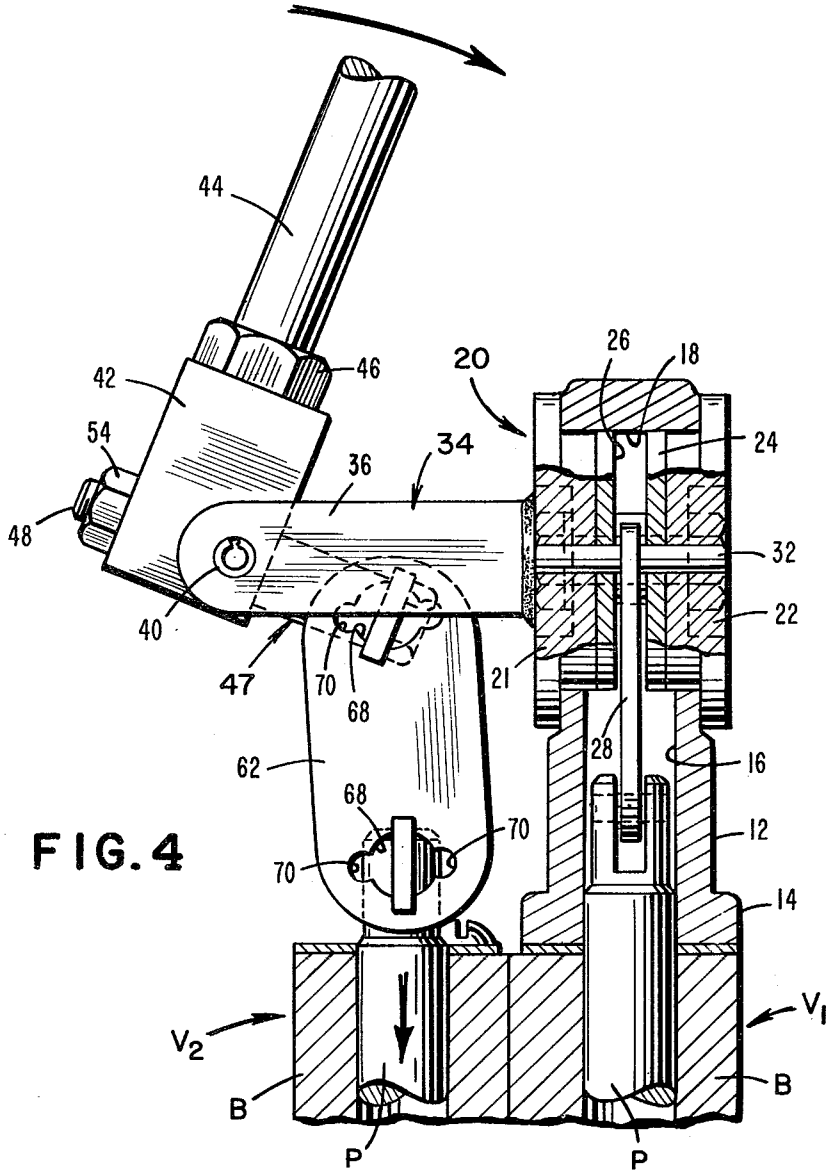
FIG. 4 is a partial sectional view of the single lever control showing the housing and actuator for one valve as well as the valve bodies in section.

The single lever control 10 is associated with the valves V1 and V2 by being fixedly mounted relative to the bodies B of the two valves. The main supporting component consists of housing 12 which is suitably secured, as by cap screws (not shown), by way of its base flange 14 to the upper end of the body B of valve V1. The housing 12 has a cavity 16 (see FIGS. 4, 6 and 8) which encloses the actuator for the valve V1.

The upper end of the housing 12 has a horizontal bore 18 which rotatably supports a hub 20. As best shown in FIG. 8, hub 20 is made up of a pair of outer discs 21 and 22 which are secured together by a bolt and nut fastener 23, these two discs sandwiching therebetween a central disc 24 which has a peripheral groove 26. The dimensions of the outer discs 21 and 22, and disc 24 which make up hub 20 are such that when clamped together by the bolt and nut fastener 23, the hub 20 remains free to rotate within the bore 18 of housing 12. In other words, the flanges on outer discs 21 and 22 slide freely over the faces of housing 12 adjacent the ends of bore 18.

A connector 28 passes downwardly within cavity 16 of housing 12 with its lower end being secured by pin 30 to the upper bifurcated end of the plunger P of valve V1. The upper end of connector 28 is connected to hub 20 made up of discs 21, 22 and 24 by means of a pin 32. As best shown in FIGS. 6 and 7, pin 32 is located at a point offset from the rotational axis of hub 20. It will thus be seen that rotation of hub 20 in opposite directions will effect raising and depressing the plunger P of valve V1 through force transmitted by means of connector 28. Although a positive connection between hub 20 and connector 28 is provided by pin 32 engaging through the three discs making up hub 20 in the embodiment illustrated, this pin may be shorter in length to only engage with the central disc 24. In such a construction the clamping of the three discs together and the thickness of the central disc 24 is selected so that the frictional engagement between the faces of the outer discs 21 and 22 abutting with the opposed faces of central disc 24 will provide sufficient driving force to connector 28 to raise or depress the plunger P of valve V1 incident rotation of hub 20 in one or the other of its directions of movement.

It should be mentioned that a housing having a rotary hub supported thereon, with an offset connector coupling the hub to the valve plunger, forms a type of actuator employing a single control lever for a single valve which is commercially available for hydraulic valve actuation. In such a mechanism the control lever is connected to the hub to rotate it in one direction or the other so as to raise or depress the valve plunger and thereby achieve the desired control function to be carried out by the valve. In such an application, each valve in an array of several valves would have its own control lever for the rotatable hub and an offset connector to perform valve operation by raising or depressing the individual valve plunger.

In applicant's invention the single lever to actuate multiple valves and the actuating mechanism for valve V2, which is mounted adjacent valve V1, are supported on housing 12 through the means of hub 20 rotatable in bore 18 of housing 12. Thus a yoke 34 is formed as an integral part of hub 20 so as to provide parallel arms 36 and 38 disposed on opposite sides of the rotational axis of hub 20. The yoke 34 is formed on hub 20 by welding arms 36 and 38 to diametrically disposed positions on the perimeter of outer disc 21 of hub 20. The ends of arms 36 and 38 are provided with apertures each of which retains a pin 40 that extends inwardly of the arm in which it is retained to provide a pivot support for a pivot block 42. This pivot block is thereby pivotally mounted on yoke 34 by pins 40 extending inwardly of the yoke arms.

A control lever 44 is threaded into an internally threaded socket is pivot block 42 and a locking nut 46, threaded onto the end of control lever 44, is tightened down against pivot block 42 to firmly secure lever 44 to pivot block 42.

Pivot block 42 also carries an extension member 47 which projects toward hub 20 and is disposed between the arms 36 and 38 of yoke 34. The single lever control has the extension member 47 preferably disposed perpendicular to the control lever 44 with its axis in the plane that includes the rotation axis of hub 20. The axis of the extension member 47 is aligned with the rotation axis of hub 20 in the neutral position of the single lever control as shown in FIGS. 1 and 8.

The extension member 47 on pivot block 42 is provided by a bolt 48 which is threaded into an internally threaded bore 50 that extends through pivot block 42. A spacer 52 in the form of a sleeve surrounding the shank of bolt 48 defines, between its end and the underside of the bolt head, a space to accommodate the linkage, hereinafter described, through which actuating forces are transferred from extension member 47 to actuate the plunger P of valve V2. Since this linkage should be pivotal on the extension member, for reasons that will become apparent, the bolt 48 is threaded into bore 50 so that spacer 52 and the bolt head leave sufficent space therebetween for free pivoting of the linkage connection. A lock nut 54 is threaded onto the exposed end of bolt 48 ad tightened against pivot block 42 to fix bolt 48 in its desired location for proper pivotal connection with the hereinafter described linkage.

Figure 3:
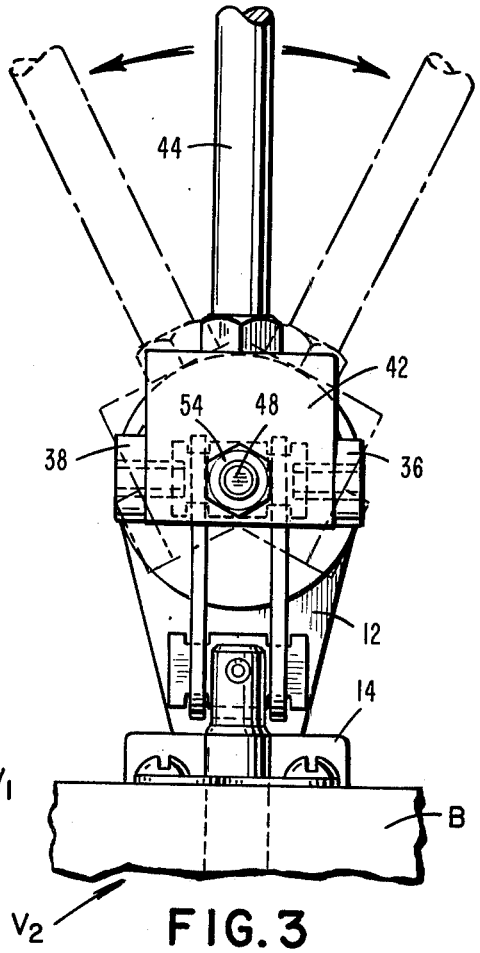
FIG. 3 is an end elevational view of the single lever control shown in FIG. 1.
Figure 5:
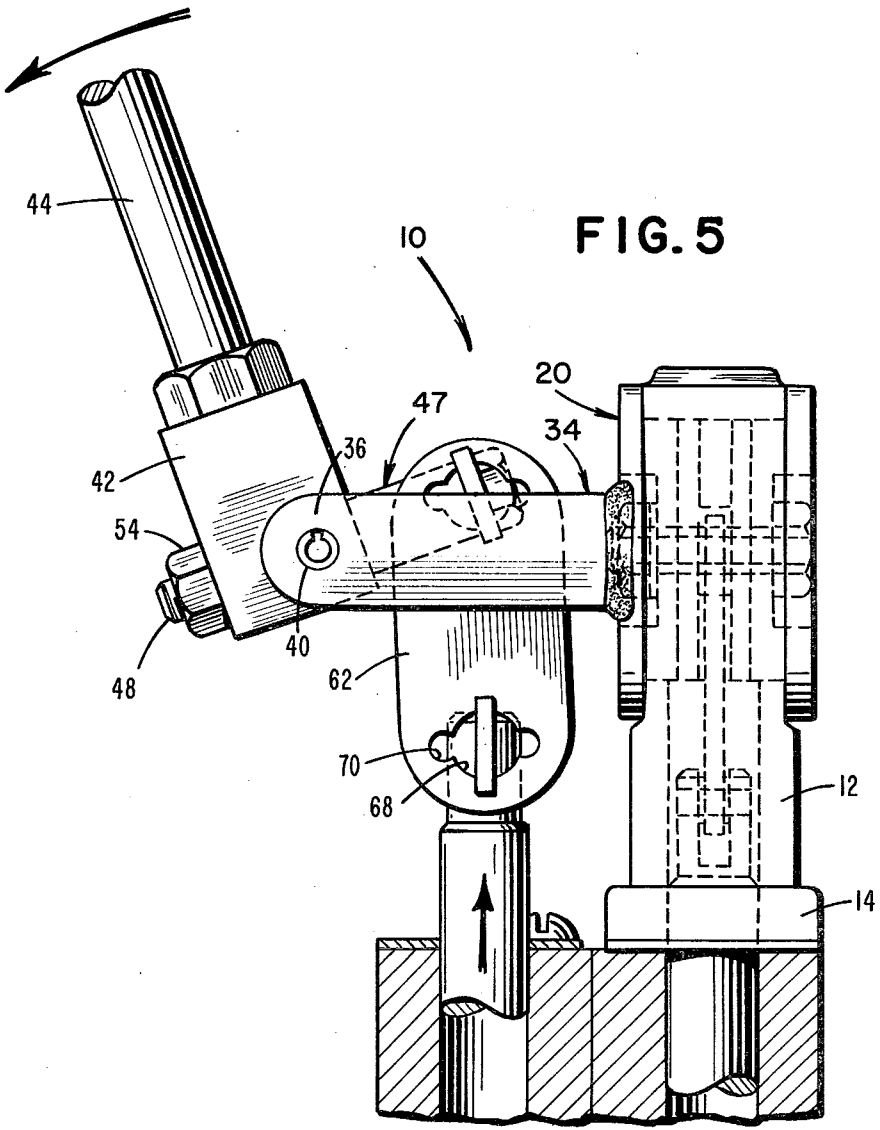
FIG. 5 is a front elevational view similar to FIG. 1.

From the above-described structure, it will be appreciated that swinging movements of the single control lever 44 in the directions shown on FIG. 3 will cause hub 20 to be rotated back and forth by forces transmitted through block 42 and yoke 34 to thereby raise and depress the plunger P of valve V1. The effect of this operation in actuation of valve V1 is indicated by the arrows on FIG. 6. Similarly, swinging movement in the directions of the control lever 44 shown on FIGS. 4 and 5 will, through the linkage means hereinafter described, act to raise or depress the plunger P of valve V2. It will be appreciated that a combination of movements of the plungers of the two valves V1 and V2 may be achieved by appropriately moving the control lever 44 in a direction including a component of movement from both the plane of FIGS. 4 and 5 and the plane of FIG. 3.

The linkage connecting the extension member 47 to the plunger P of valve V2 includes a first cross bar element 56 which has a central opening through which the shank of bolt 48 passes. The cross bar element is retained between the end of spacer 52 and the head of bolt 48 to be freely pivotal around the bolt in conjunction with movements of the control lever 44 to actuate one or the other or a combination of both of valves V1 and V2. A second cross bar element 58 is connected to the upper bifurcated end of plunger P of valve V2 by means of pin 60 extending through a central opening in element 58. A pair of tie links 62 are pivotally engaged with the opposite ends of the pair of cross bar elements 56 and 58 to tie the elements together, retaining them in the parallel relationship as best shown in FIG. 7 so that pivoting of the control lever 44 relative to the hub about the pivot supporting pins 40 on the yoke arms 36 and 38 will actuate the hydraulic V2 by raising and depressing its plunger P.

As best shown in FIG. 7, each of the cross bar elements not only has a centrally disposed opening, with such opening in element 56 pivotally engaging around the shank of bolt 48 and the opening in element 58 engaging with pin 60 that connects it to the valve plunger, but also each cross bar element has a reduced cross section portion 64 disposed inwardly of each of its ends leaving a larger cross section segment 66 outwardly of portion 64. In their mounted or assembled position, each of the flat cross bar elements 56 and 58 are retained in the same plane when the control lever is in its neutral position as shown in FIGS. 1 and 8. Thus element 56 is retained between the end of spacer 52 and head of bolt 48 and element 58 is retained by the bifurcated end of plunger P on valve V2.

The tie links 62 are formed to cooperate with and be retained in the reduced cross section portion 64 adjacent the ends of the cross bar elements. Thus each link 62 has a circular bore 68 provided adjacent each end of the link. This bore is made only slightly larger in diameter than the maximum diameter of the reduced cross section portion 64 of the cross bar elements. Each of the bores in the ends of links 62 has a enlargement 70 in the bore perimeter. As shown on the drawings the enlargement 70 consists of the perimeter of the bore 68 being enlarged at diametrically opposite points on the bore perimeter. The enlargement is thus formed in a direction normal to the longitudinal axis of each link 62. It will be understood that although the illustrated embodiment shows diametrically opposite sections of the bore 68 perimeter being enlarged, the enlargement of the bore to receive the end segment 66 on a cross bar element could be formed by simply increasing the lateral width of the bore at only one section of the bore perimeter.

The formation of the cross bar elements 56 and 58, and configuration of the tie links 62 enables easy assembly and disassembly of the linkage formed by these components with a minimum number of tools being required. Still the construction assures that the linkage may not become disassembled once the cross bar elements 56 and 58 are secured in their operative positions by bolt 48 and spacer 52 of the extension member 47 and between the bifurcations of plunger P, held in place by pin 60. Thus it will be appreciated that in assembly of the linkage, the cross bar elements 56 and 58 will be turned relative to bores 68 in the tie links 62 so that the end segments 66 of the elements will pass through the enlargements 70 of bores 68. Then the cross bar elements are turned so that the reduced cross section portions 64 are received snugly in bores 68 with the end segments 66 preventing the links from being removed from the cross bar elements. This action functions to keep the linkage fully assembled as shown in FIG. 7 with the cross bar elements retained on extension member 47 and by the bifurcated end of plunger P of valve V2. Then tie links 62 are securely held in place while relative movement between the tie links and cross bar elements is permitted as the control lever 44 is moved in one or another, or a combination of directions, to actuate the valves separately or conjointly.

It will be understood that in an existing hydraulic control array of valves where each valve has had its own individual control lever, the valve V2 as shown in the embodiment would have had a housing and actuator such as the housing 12 and the actuator within the housing for valve V1 as heretofore described. To convert to the single handle control of the instant invention, such housing and its enclosed actuator, originally associated with valve V2, would be removed. Then a hub 20 carrying the mechanism of the single control lever and actuating linkage for valve V2 would be substituted for such housing to provide the single control lever and actuator for valve V2.

Preferably a seal element 80 which surrounds the plunger P of valve V2 is provided. This element is suitably fastened to the surface of body B of this valve by screws 82. The element 80 may simply be formed so that the screws 82 can egage in the internally threaded bores which are usually provided in the valve body to receive the cap screws that normally would retain a housing 12 with its enclosed actuator on the body of the valve when the valve employs a single lever for actuation of such single valve.

Although the embodiment illustrated and described relates to a single control lever for only two reciprocable hydraulic valves, it will be understood that the actuating forces from the control lever movements may be used to actuate more than two control devices and actuate other than reciprocable hydraulic valves. Also the single lever control disclosed in not limited to use with backhoe hydraulic control systems but may be used with any type of equipment where the single lever control capability is desired for actuating a plurality of control devices.

While an illustrative embodiment of this invention has been shown and described along with alternatives in construction, it will be apparent to those skilled in the art that this invention is capable of variation and modification beyond those that have been suggested, so that the scope of the invention should be limited only by the scope of the appended claims.

We claim:

1. A single lever control for actuating spaced control devices such as hydraulic valves comprising:

a housing having means to mount it on the body of one control device and support the actuating mechanism for another adjacent control device exteriorly of said housing, a hub rotatably supported on said housing having a connector interiorly of said housing and pivotally secured to said hub offset from the rotation axis of said hub which connector is connectible to actuate the one control device upon rotation of said hub relative to said housing;

support means on said hub pivotally supporting a control lever remote from said hub on an axis perpendicular to and intersecting the rotation axis of said hub, said lever being pivotable relative to said hub and operable to rotate said hub relative to said housing by movements of said control lever;

an extension member extending generally perpendicular to the pivot axis of said control lever; and linkage means pivotally connected to said extension member and pivotally connectible to the other control device to actuate such other control device through said linkage means and extension member upon movement of said control lever about its pivot axis.

2. A single lever control as recited in claim 1 wherein said support means is formed by a yoke on said hub providing parallel arms on opposite sides of the rotational axis of said hub, and said control lever and said extension member are mounted on a pivot block which is pivotally supported between said parallel arms.

3. A single lever control as recited in claim 2 wherein said control lever is removably secured to said pivot block, and said extension member is provided by a bolt threaded into said pivot block which carries a spacer to form a pivot connection for said linkage means between the end of said spacer and the head of said bolt.

4. A single lever control as recited in claim 3 wherein said linkage means includes a cross bar element having a central opening therethrough which receives said bolt to be held in pivotal position between the end of said spacer and head of said bolt.

5. A single lever control as recited in claim 1 wherein said linkage means comprises a first cross bar element pivotally supported on said extension member and a second cross bar element having means to connect it to another control device with a pair of links pivotally engaging the opposite ends of said cross bar elements to tie said elements together so that pivoting of said control lever relative to said hub will actuate the other control device through movement of said extension member.

6. A single lever control as recited in claim 5 wherein each of said cross bar elements has a reduced cross section portion inwardly of each of its ends, and each end of each of said links has a bore to receive said reduced cross section portion of the cross bar element with which it is to engage, said bore at each end of said links having an enlargement in at least one part of its perimeter to receive the end segment of the cross bar element with which it is to engage that is disposed outwardly of the reduced cross section portion on the link.

7. A single lever control for actuating spaced control devices such as hydraulic valves comprising:

a housing to be fixedly mounted relative to the control devices and rotatably supporting a hub having connecting means thereon to connect with and actuate one control device upon rotation of said hub relative to said housing:

a yoke formed on said hub;

a control lever pivotally supported on said yoke remote from said hub to be pivotable relative to said yoke and rotate said yoke and said hub relative to said housing by movements of said control lever;

a extension member extending generally perpendicularly from said control lever;

a first cross bar element pivotally supported on said extension member and a second cross bar element having means to connect it to another control device; and a pair of links pivotally engaging the opposite ends of said cross bar elements to tie said elements together so that pivoting of said control lever relative to said yoke will actuate the other control device through movement of said extension member.

8. A single lever control as recited in claim 7 wherein said yoke carries a pivot block pivotally supported thereon, and said control lever and said extension member are secured to said pivot block to move therewith.

9. A single lever control as recited in claim 7 wherein each of said cross bar elements has a reduced cross section portion inwardly of each of its ends, and each end of each of said links has a bore to receive said reduced cross section portion of the cross bar element with which it is to engage, said bore at each end of said links having an enlargement in at least one part of its perimeter to receive the end segment of the cross bar element with which it is to engage that is disposed outwardly of the reduced cross section portion on the link.

10. A single lever control for actuating spaced control devices such as hydraulic valves comprising:

a hosing to be fixedly mounted relative to the control devices and rotatably supporting a hub having connecting means thereon to connect with and actuate one control device upon rotation of said hub relative to said housing;

support means on said hub pivotally supporting a control lever remote from said hub on an axis perpendicular to and intersecting the rotation axis of said hub, said lever being pivotable relative to said hub and operable to rotate said hub relative to said housing by movements of said control lever;

an extension member extending generally perpendicular to the pivot axis of said control lever; and linkage means pivotally connected to said extension member and pivotally connectible to the other control device to such other control device through said linkage means and extension member upon movement of said control lever about its pivot axis, said linkage means comprising an assembly of pivotally interconnected parts which may be readily assembled and disassembled by rotating cross bar elements relative to openings in tie links making up said assembly.

11. A single lever control for actuating spaced control devices such as hydraulic valves comprising:

a housing to be fixedly mounted relative to the control devices and rotatably supporting a hub having connecting means to connect with and actuate one control device upon rotation of said hub relative to said housing;

a yoke formed on said hub;

a pivot block pivotally supported on said yoke remote from said hub;

a control lever secured to said block to pivot said block relative to said yoke and rotate said yoke and said hub relative to said housing by movements of said control lever;

said block carrying an extension member projecting toward said hub and between the arms of said hub and generally perpendicular to said control lever;

a first cross bar element pivotally supported on said extension member and a second cross bar element having means to connect it to another control device; and a pair of links pivotally engaging the opposite ends of said cross bar elements to tie said elements together so that pivoting of said pivot block relative to said yoke will actuate the other control device through movement of said extension member.

* * * * *